US010410852B2

(12) United States Patent
Hosoi

(10) Patent No.: US 10,410,852 B2
(45) Date of Patent: Sep. 10, 2019

(54) ANALYTICAL DEVICE

(71) Applicant: SHIMADZU CORPORATION, Kyoto-shi, Kyoto (JP)

(72) Inventor: Kosuke Hosoi, Kyoto (JP)

(73) Assignee: SHIMADZU CORPORATION, Kyoto-shi, Kyoto (JP)

( * ) Notice: Subject to any disclaimer, the term of this patent is extended or adjusted under 35 U.S.C. 154(b) by 0 days.

(21) Appl. No.: 16/059,380

(22) Filed: Aug. 9, 2018

(65) Prior Publication Data

US 2019/0051505 A1 Feb. 14, 2019

(30) Foreign Application Priority Data

Aug. 10, 2017 (JP) ..... 2017-155561

(51) Int. Cl.

| | |
|---|---|
| ***H01J 49/00*** | (2006.01) |
| ***H01J 49/28*** | (2006.01) |
| ***H01J 49/02*** | (2006.01) |
| ***H01J 49/04*** | (2006.01) |
| ***H01J 49/16*** | (2006.01) |
| ***H01J 49/24*** | (2006.01) |
| ***H01J 49/42*** | (2006.01) |

(52) U.S. Cl.

CPC ..... *H01J 49/282* (2013.01); *H01J 49/02* (2013.01); *H01J 49/0422* (2013.01); *H01J 49/161* (2013.01); *H01J 49/24* (2013.01); *H01J 49/424* (2013.01)

(58) Field of Classification Search

CPC .... H01J 49/282; H01J 49/424; H01J 49/0422; H01J 49/24; H01J 49/161; H01J 49/02

USPC ..... 250/281, 282, 288

See application file for complete search history.

(56) References Cited

U.S. PATENT DOCUMENTS

2005/0189487 A1* 9/2005 Iwamoto ..... H01J 49/005 250/288

2016/0189944 A1 6/2016 Arii et al.

FOREIGN PATENT DOCUMENTS

WO 2015/022815 A1 2/2015

OTHER PUBLICATIONS

Extended European Search Report dated Jan. 7, 2019 issued by the European Patent Office in counterpart application No. 18188354.7.

* cited by examiner

*Primary Examiner* — Michael Maskell

(74) *Attorney, Agent, or Firm* — Sughrue Mion, PLLC

(57) ABSTRACT

An analytical device includes: a valve assembly that is connected to a plurality of gas supply conduits; and a gas supply chamber to which a plurality of gases are supplied through the valve assembly, wherein: the valve assembly includes a plurality of valves that regulate flow rates of the plurality of gases supplied to the gas supply chamber through the plurality of gas supply conduits, a fixing member that integrally fixes the plurality of valves, a plurality of first sealing members that seal the plurality of valves against the fixing member, and a retainer that is fastened to the fixing member to integrally press the first sealing member against the fixing member.

17 Claims, 4 Drawing Sheets

ANALYTICAL DEVICE

INCORPORATION BY REFERENCE

The disclosure of the following priority application is herein incorporated by reference: Japanese Patent Application No. 2017-155561 filed Aug. 10, 2017

BACKGROUND OF THE INVENTION

1. Field of the Invention

The present invention relates to an analytical device.

2. Description of Related Art

Analytical devices having a vacuum chamber into which a plurality of types of gases are introduced from a plurality of gas storage containers are known. International Publication No. 2015/022815 discloses an analytical device including an ion trap into which helium is introduced as a cooling gas for attenuating kinetic energy of ions in the ion trap and argon gas is introduced as a CID gas for colliding with ions to cause Collision-Induced Dissociation (CID).

SUMMARY OF THE INVENTION

From the viewpoint of a reduction in size of the analytical device, a connecting part connecting a plurality of gas conduits, which extend from a plurality of gas storage containers, to the vacuum chamber is designed to be as compact as possible, while maintaining the sealability of the vacuum chamber.

According to the 1st aspect of the present invention, an analytical device comprises: a valve assembly that is connected to a plurality of gas supply conduits; and a gas supply chamber to which a plurality of gases are supplied through the valve assembly, wherein: the valve assembly comprises a plurality of valves that regulate flow rates of the plurality of gases supplied to the gas supply chamber through the plurality of gas supply conduits, a fixing member that integrally fixes the plurality of valves, a plurality of first sealing members that seal the plurality of valves against the fixing member, and a retainer that is fastened to the fixing member to integrally press the first sealing member against the fixing member.

According to the 2nd aspect of the present invention, the analytical device according to the 1st aspect further comprises: a plurality of pressing members that are forced by the retainer to press the plurality of first sealing members against the fixing member.

According to the 3rd aspect of the present invention, in the analytical device according to the 1st or 2nd aspect, the retainer comprises a supporting part that supports one or more of a plurality of joints connected to the plurality of gas supply conduits that guide gases to the plurality of valves.

According to the 4th aspect of the present invention, the analytical device according to 3rd aspect further comprises: a connecting conduit that is connected to the joint on one end and to the valve on another end, the joint being connected to the connecting conduit on one end and to the gas supply conduits on another end.

According to the 5th aspect of the present invention, in the analytical device according to the 3rd or 4th aspect, the retainer comprises a first plate-like member that is fastened to the fixing member and a second plate-like member comprising the supporting part.

According to the 6th aspect of the present invention, in the analytical device according to the 5th aspect, the first plate-like member and the second plate-like member are arranged such that a plane formed by the first plate-like member and a plane formed by the second plate-like member intersect each other.

According to the 7th aspect of the present invention, in the analytical device according to any one of the 1st through 6th aspects, the valve is a pulse valve.

According to the 8th aspect of the present invention, in the analytical device according to any one of the 1st through 7th aspects, the valve assembly comprises a mounting member that is attached to a partition wall of the analytical device and a penetrating member that is provided on a back surface side of the mounting member so as to protrude therefrom and penetrates through the partition wall, wherein the mounting member is attached to the partition wall with a second sealing member therebetween, thereby sealing the vacuum chamber in the analytical device.

According to the 9th aspect of the present invention, the analytical device according to any one of the 1st through 8th aspects comprises: a mass spectrometer in which ions and the gases are supplied to the gas supply chamber, wherein: the gas supply chamber comprises an electrode that controls the ions, and the plurality of gases, whose flow rates are regulated by the plurality of valves, comprise at least a gas species for a cooling gas and a gas species for a CID gas.

DESCRIPTION OF EMBODIMENTS

An embodiment of the present invention applied to a mass spectrometry device will be described below with reference to the drawings. The mass spectrometry device is referred to as one of analytical devices (analyzers)."

First Embodiment

Figure 1:
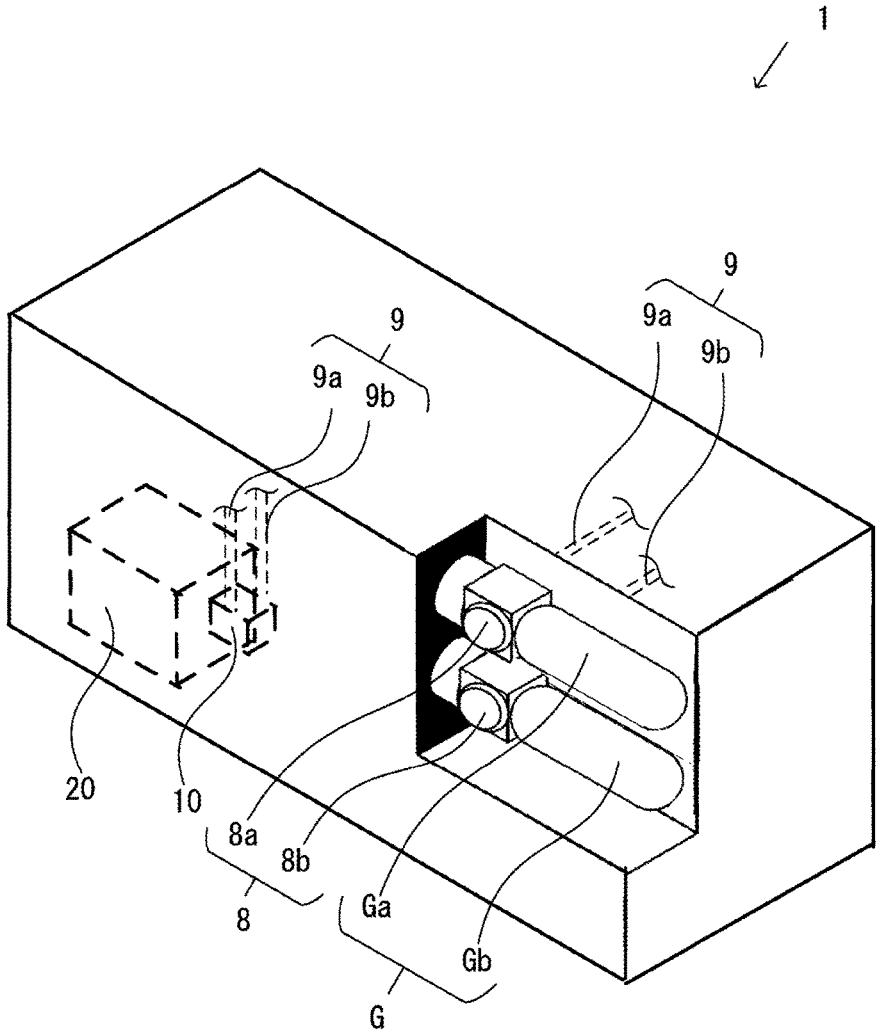
FIG. 1 is a perspective view showing a schematic configuration of an analytical device in an embodiment.
Figure 2:
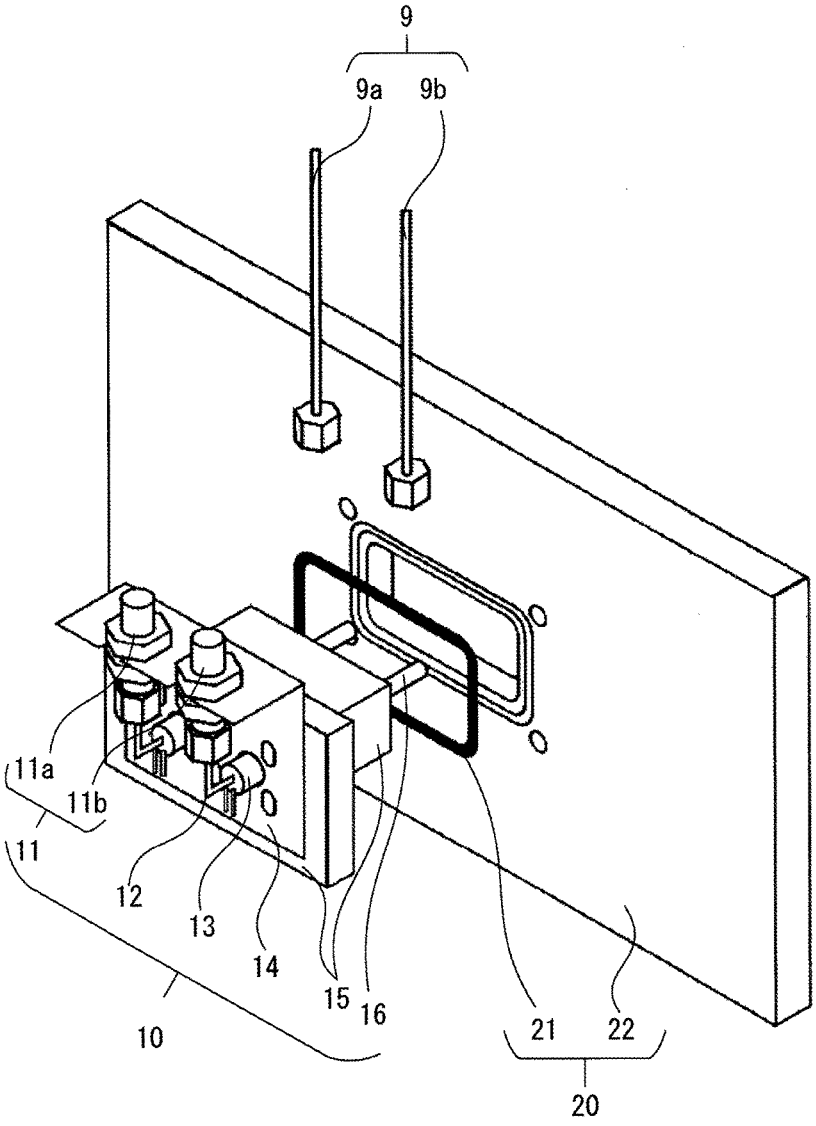
FIG. 2 is a perspective view showing a connecting part of a valve assembly placed towards a side surface of a vacuum chamber in the analytical device in the present embodiment.
Figure 3:
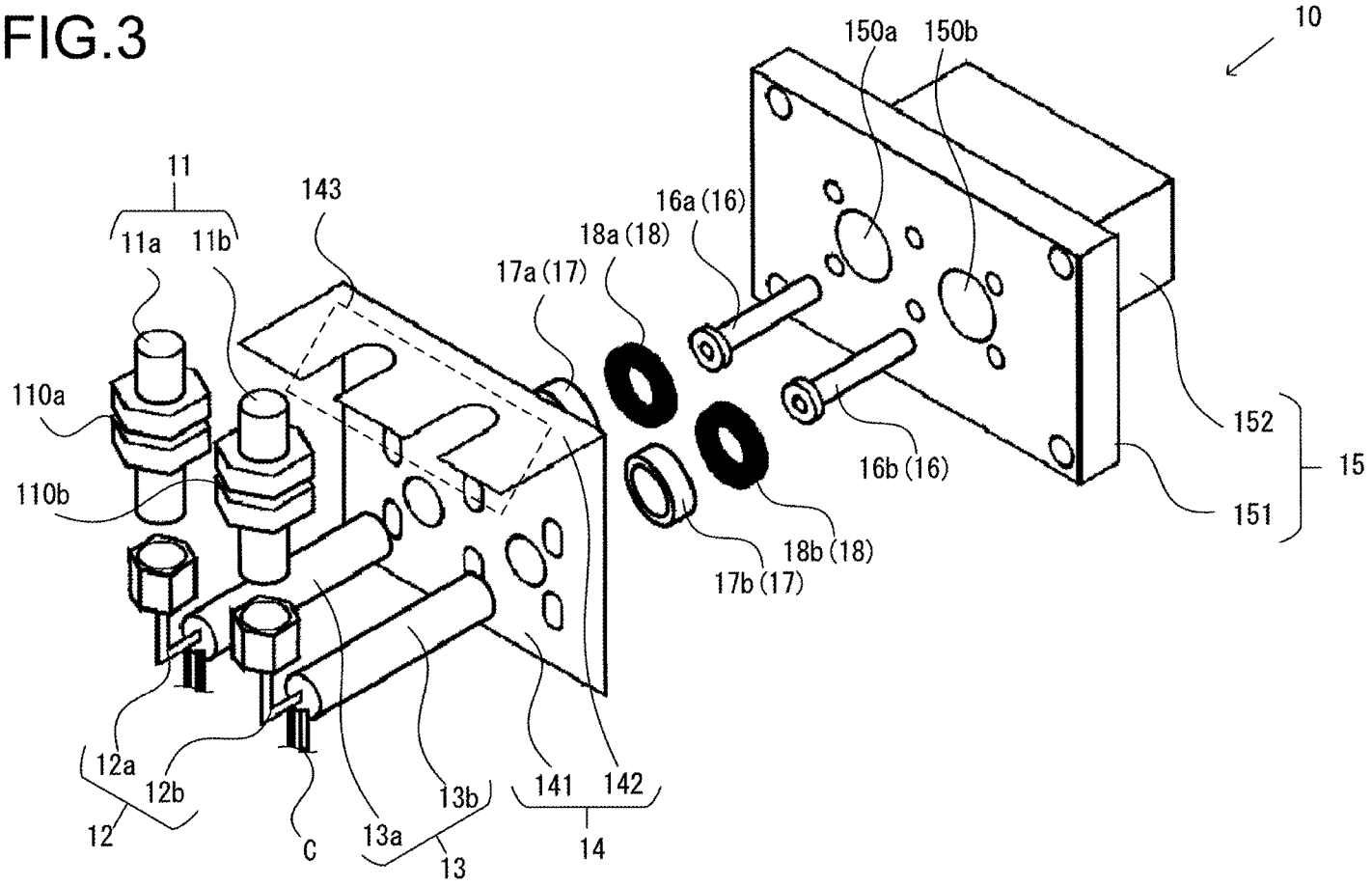
FIG. 3 is an exploded view of the valve assembly.
Figure 4:
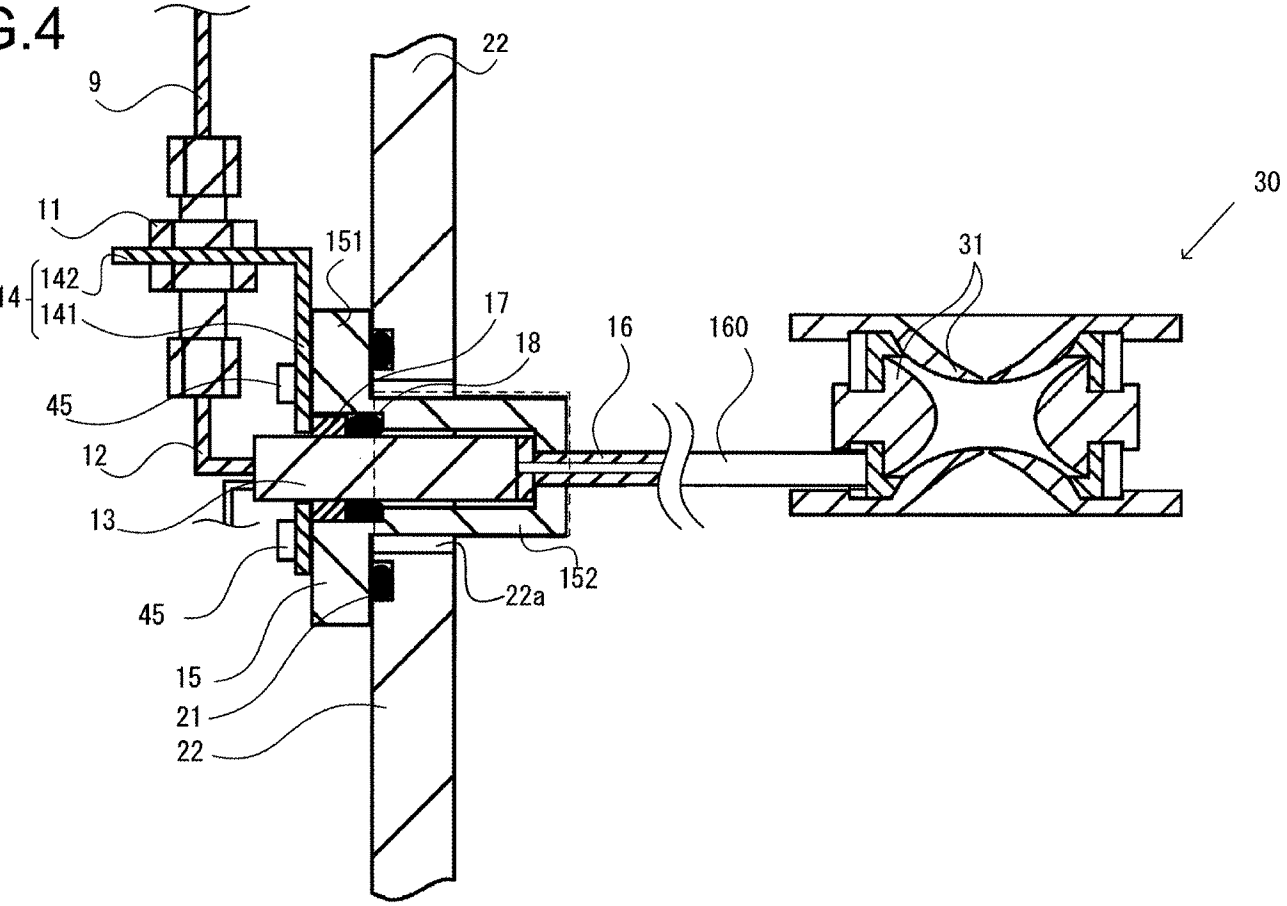
FIG. 4 is a cross-sectional view showing the valve assembly and an ion trap.

A first embodiment will be described with reference to FIGS. 1 to 4. FIG. 1 is a perspective view showing a schematic configuration of a mass spectrometry device 1 according to a first embodiment. FIG. 2 is a perspective view showing a connecting part of a valve assembly placed towards a side surface of a vacuum chamber in the mass spectrometry device 1. FIG. 3 is an exploded view of the valve assembly. FIG. 4 is a cross-sectional view of the valve assembly and an ion trap.

The mass spectrometry device 1 includes regulators 8*a*, 8*b* for gas storage containers Ga, Gb (hereinafter referred to as regulators), a vacuum chamber 20, gas supply conduits 9*a*, 9*b* that are connected to the regulators 8*a*, 8*b* and supply gases to be introduced into the vacuum chamber 20, and a valve assembly 10 that is a connecting part between the gas supply conduits 9*a*, 9*b* and the vacuum chamber 20 (see FIG. 1). The vacuum chamber 20 includes an ion trap 30 therein (see FIG. 4). Once introduced into the mass spectrometry device 1, a sample to be analyzed is ionized and then introduced through a tube (not shown in the figures) into the ion trap 30. In the ion trap 30, the sample is controlled by an electromagnetic field generated by voltages applied to electrodes 31 (see FIG. 4) so that the sample is discharged from the ion trap 30 and detected as appropriate.

Gases stored in the gas storage containers Ga, Gb are supplied to the ion trap 30 inside the vacuum chamber 20 through the gas supply conduits 9*a*, 9*b* respectively and the valve assembly 10, while flow rates of the gases are regulated by the respective regulators 8*a*, 8*b*. The gas storage container Ga stores, for example, helium gas or the like as a cooling gas. The gas storage container Gb stores, for example, argon gas or the like as a CID gas.

Note that the gases stored in the gas storage containers Ga, Gb are not particularly limited to particular types of gases. Furthermore, the number of the regulators 8*a*, 8*b* and thus the number of the gas storage containers Ga, Gb are not limited to a particular number, as long as the number is more than one.

The valve assembly 10 is assembled to a partition wall 22 of the vacuum chamber via an O-ring 21 which is a sealing member (see FIG. 2). After the valve assembly 10 is assembled to the partition wall 22 of the vacuum chamber, joints 11*a*, 11*b* (see FIG. 3) and the gas supply conduits 9*a*, 9*b*, respectively, are connected to each other. This ensures the sealability of the vacuum chamber 20 and allows a plurality of gases from the gas storage containers Ga, Gb to be introduced into the vacuum chamber 20. In the present embodiment, the term "vacuum chamber" refers to a chamber in which the inner pressure can be maintained to a pressure different from its ambient pressure.

As shown in an exploded view of FIG. 3, the valve assembly 10 includes the joints 11*a*, 11*b*; pulse valves 13*a*, 13*b*; L-shaped connecting conduits 12*a*, 12*b* that respectively connect the joints 11*a*, 11*b* and the pulse valves 13*a*, 13*b*; a retainer 14; pressing members 17*a*, 17*b*; O-rings 18*a*, 18*b*; gas introduction conduits 16*a*, 16*b*; and a fixing member 15 for supporting and fixing the components of the valve assembly 10. The retainer 14 includes a first plate-like member 141 and a second plate-like member 142. A plane formed by the first plate-like member 141 and a plane formed by the second plate-like member 142 intersect at an angle of approximately 90 degrees. The fixing member 15 includes a mounting plate 151, a pulse valve receiving member 152, and through holes 150*a*, 150*b*.

As described later, the retainer 14 has a function of integrally pressing the two pressing members 17*a*, 17*b* and a function of integrally holding the two joints 11*a*, 11*b*. The former function is related to the first plate-like member 141 and the latter is related to the second plate-like member 142.

The joints 11*a*, 11*b*, respectively, connect to the gas supply conduits 9*a*, 9*b* on one ends and to the connecting conduits 12*a*, 12*b* on the other ends. In other words, the joints 11*a*, 11*b* are members for connecting the conduits 9*a*, 9*b*, which supply gases to the pulse valves 13*a*, 13*b*, to the valve assembly 10. The joints 11*a*, 11*b*, respectively, have recesses 110*a*, 110*b* on their outer circumferential surface so that the recesses 110*a*, 110*b* engage with cutout portions in a supporting part 143 in the second plate-like member 142 of the retainer 14.

After the valve assembly 10 is attached to the partition wall 22 of the vacuum chamber 20, an external force applied to the gas supply conduits 9*a*, 9*b* may act on the valve assembly 10, i.e., the joints 11*a*, 11*b*. With the recesses 110*a*, 110*b*, respectively, the joints 11*a*, 11*b* are supported in the second plate-like member 142 of the retainer 14 (see FIG. 2). It is therefore possible to prevent external forces applied to the gas supply conduits 9*a*, 9*b* from transmitting to the connecting conduits 12*a*, 12*b* and connecting parts between the pulse valves 13*a*, 13*b* and the connecting conduits 12*a*, 12*b*, thereby damaging them.

From the viewpoint of supporting the joints 11*a*, 11*b* as described above, the second plate-like member 142 of the retainer 14 does not necessarily intersect the first plate-like member 141 at an angle of approximately 90 degrees. However, the arrangement of the second plate-like member 142 intersecting the first plate-like member 141 at an angle of approximately 90 degrees allows the joints 11*a*, 11*b* and the gas supply conduits 9*a*, 9*b* to be arranged along the partition wall 22 of the vacuum chamber 20. This can make the mass spectrometry device 1 more compact. In other words, axes of the joints 11*a*, 11*b* and the gas supply conduits 9*a*, 9*b* extend in parallel to or substantially in parallel to and along the outer surface of the partition wall 22 to achieve compactness.

As described above, the connecting conduits 12*a*, 12*b* are L-shaped and are provided integrally on the pulse valves 13*a*, 13*b*. One ends of the connecting conduits 12*a*, 12*b* are connected to the joints 11*a*, 11*b*. The joints 11*a*, 11*b* connect to the gas supply conduits 9*a*, 9*b*, respectively. The joints 11*a*, 11*b* connect the gas supply conduits 9*a*, 9*b* and the pulse valves 13*a*, 13*b*, respectively.

Note that the shapes of the joints 11*a*, 11*b* and the way of connection between the connecting conduits 12*a*, 12*b* and the joints 11*a*, 11*b* are not particularly limited.

The pulse valves 13*a*, 13*b* receive signals from a controller (not shown in the figures) that controls the pulse valves 13*a*, 13*b*, via a control cord C (see FIG. 3). Based on the signals, the pulse valves 13*a*, 13*b* regulate flow rates of gases from the gas storage containers Ga, Gb to discharge the gases to the ion trap 30 through the gas introduction conduits 16*a*, 16*b*, respectively, at an appropriate time.

The gas introduction conduits 16*a*, 16*b* and the pulse valves 13*a*, 13*b* are connected as described below.

The connection will be described with reference to FIG. 4. The fixing member 15 has a mounting plate 151 that abuts against the outer surface of the partition wall 22, and a pulse valve receiving member 152 (a portion of the fixing member 15 surrounded by a broken line) that is inserted through a rectangular opening 22*a* of the partition wall 22 and extends into the vacuum chamber 20. The mounting plate 151 has through holes 150*a* and 150*b* drilled therethrough. The through holes 150*a*, 150*b* extend deep into the pulse valve receiving member 152. The inner diameters of the through holes 150*a*, 150*b* on their inlet sides correspond to the outer diameters of the O-rings 18*a*, 18*b*, and the inner diameters of the through holes 150*a*, 150*b* on their deep sides, i.e., the inner diameters on the inner side of the pulse valve receiving member 152 are slightly larger than the outer diameters of the pulse valves 13*a*, 13*b*. In other words, the through holes 150*a*, 150*b* are stepped holes having a large-diameter passage and a small-diameter passage.

Through holes are formed in a bottom wall of the pulse valve receiving member 152, through which shafts of the gas introduction conduits 16*a*, 16*b* are inserted. The pulse valves 13*a*, 13*b* and the gas introduction conduits 16*a*, 16*b*, respectively, are inserted through the through holes 150*a*, 150*b* from the front surface side of the mounting plate 151. The ends of the gas introduction conduits 16*a*, 16*b* project from the fixing member 15 and are connected to the ion trap 30 of the vacuum chamber 20 via internal conduits 160. The pulse valves 13*a*, 13*b* and the gas introduction conduits 16*a*, 16*b* are connected in the through holes 150*a*, 150*b*.

The first plate-like member 141 of the retainer 14 and the fixing member 15 are screwed and fastened with screws 45 (see FIG. 4). Before this fastening, the gas introduction conduits 16*a*, 16*b* and pulse valves 12*a*, 12*b*, respectively, are inserted in this order through the through holes 150*a*, 150*b* of the mounting plate 151. Here, the ends of the gas introduction conduits 16*a*, 16*b* project from the back surface side of the fixing member 15. By fastening the retainer 14 to the fixing member 15 with the screw 45 in this state, the first plate-like member 141 of the retainer 14 presses the pressing members 17*a*, 17*b*, and the pressing members 17*a*, 17*b* press integrally the respective O-rings 18*a*, 18*b* and the fixing member 15 (see FIG. 4). The pressed O-rings 18*a*, 18*b* seal between the pulse valves 13*a*, 13*b* and the fixing member 15. In FIGS. 2 and 3, the illustration of the screw 45 is omitted.

Note that the retainer 14 may directly press the O-rings 18*a*, 18*b* against the fixing member 15 without the pressing members 17*a*, 17*b* therebetween. Furthermore, rubber bushings or the like may be used as a sealing member, instead of the O-rings 18*a*, 18*b*.

The first plate-like member 141 of the retainer 14 integrally fixes the plurality of pulse valves 13*a*, 13*b* to the fixing member 15, with the O-rings 18*a*, 18*b* therebetween, to constitute the valve assembly 10. This allows the distance between the fixed pulse valves 13*a*, 13*b* (the distance between the through holes 150*a*, 150*b* of the fixing member 15) to be reduced. It is therefore possible to reduce the area required for attaching the connecting parts concerning the gas conduits to the partition wall 22 of the vacuum chamber 20.

In other words, the degree of freedom of the assembling operation is improved by forming the valve assembly 10 as a subassembly in advance. Thus, even if the distance between the pulse valves is smaller than that in a case where the pulse valves are directly attached to the analytical device, the joints 11*a*, 11*b* can be connected to the connecting conduits 12*a*, 12*b* without difficulty.

Gases are respectively introduced from the pulse valves 13*a*, 13*b* to the ion trap 30 through the gas introduction conduits 16*a*, 16*b* and the internal conduits 160 of the vacuum chamber 20.

Note that the gases discharged to the gas introduction conduits 16*a*, 16*b* may be directly introduced into the chamber the gases are supplied to, without passing through the internal conduits 160. In other words, in the present embodiment, the gas introduction conduits 16*a*, 16*b* projecting from the back surface of the fixing member 15 are connected to the internal conduit 160 in the vacuum chamber 20, as shown in FIG. 4. However, the gas introduction conduits 16*a*, 16*b* may be directly connected to the ion trap 30.

According to the mass spectrometry device in the first embodiment described above, the following operational effects can be achieved.

(1) A mass spectrometry device 1 in the present embodiment includes a valve assembly 10 connected to a plurality of gas supply conduits 16*a*, 16*b*, and an ion trap 30 to which a plurality of gases are supplied through the valve assembly 10. The valve assembly 10 includes: a plurality of pulse valves 13*a*, 13*b* that regulate flow rates of the plurality of gases supplied to the ion trap 30 through the plurality of gas supply conduits 16*a*, 16*b*; a fixing member 15 that integrally fixes the plurality of pulse valves 13*a*, 13*b*; a plurality of O-rings 18*a*, 18*b* that seal the plurality of pulse valves 13*a*, 13*b*, respectively, against the fixed member 15; and a retainer 14 that is fastened to the fixing member to integrally presses the plurality of O-rings 18*a*, 18*b* against the fixed member 15.

The analytical device configured as described above facilitates the assembly work, since a single retainer 14 can press two O-rings 18*a*, 18*b* to seal two gas valves 13*a*, 13*b* against the fixing member 15. Particularly, assembling the valve assembly 10 as a subassembly in advance as in the present embodiment achieves assembly of the two joints 11*a*, 11*b* and the two connecting conduits 12*a*, 12*b* or the like in a sufficient working space. As a result, even a reduced distance between the two joints 11*a*, 11*b* and thus a reduced distance between the two pulse valves 13*a*, 13*b* can ensure a sufficient working space. In other words, when the two pulse valves 13*a*, 13*b* are directly attached to the analytical device 1, the distance between the pulse valves 13*a*, 13*b* must be larger than the dimensions in the present embodiment. That is, the analytical device in the present embodiment can be configured to be compact.

(2) The mass spectrometry device 1 in the present embodiment further includes a plurality of pressing members 17*a*, 17*b* that are forced by the retainer 14 to press the plurality of O-rings 18*a*, 18*b*, respectively, against the fixing member 15. This further ensures sealing between the pulse valves 13*a*, 13*b* and the fixing member 15 by using the pressing members 17*a*, 17*b* that match with the O-rings 18*a*, 18*b*.

(3) In the mass spectrometry device 1 in the present embodiment, the retainer 14 includes a supporting part 143 that supports one or more of the plurality of joints 11*a*, 11*b* connected to the plurality of gas supply conduits 9*a*, 9*b* that guide gases to the plurality of pulse valves 13*a*, 13*b*. It is therefore possible to prevent external forces applied to the gas supply conduits 9*a*, 9*b* from transmitting to the connecting conduits 12*a*, 12*b* and connecting parts between the pulse valves 13*a*, 13*b* and the connecting conduits 12*a*, 12*b*, thereby damaging them.

(4) The mass spectrometry device 1 in the present embodiment, comprises connecting conduits 12*a*, 12*b* that are connected to the joint 11*a*, 11*b* on one ends and to the pulse valve 13*a*, 13*b* on the other end. The joint 11*a*, 11*b* are connected to the connecting conduits 12*a*, 12*b* on one ends and to the gas supply conduits 9*a*, 9*b* on the other ends. As a result, the positional relationship between the joints 11*a*, 11*b* and the pulse valves 13*a*, 13*b* can be appropriately adjusted to make the mass spectrometry device 1 more compact.

(5) In the mass spectrometry device 1 in the present embodiment, the retainer 14 includes a first plate-like member 141 fastened to the fixing member 15 and a second plate-like member 142 having the supporting part 143. It is therefore possible to prevent external forces applied to the gas supply conduits 9*a*, 9*b* from transmitting to the connecting conduits 12*a*, 12*b* and connecting parts between the pulse valves 13*a*, 13*b* and the connecting conduits 12*a*, 12*b*, thereby damaging them. Furthermore, the valve assembly 10 can be configured to be compact.

(6) In the mass spectrometry device 1 in the present embodiment, the first plate-like member 141 and the second plate-like member 142 are arranged such that a plane formed by the first plate-like member 141 and a plane formed by the second plate-like member 142 intersect each other. This allows the conduit for supplying the gases to the pulse valves 13*a*, 13*b* to be bent to make the mass spectrometry device 1 compact.

(7) In the mass spectrometry device 1 in the present embodiment, the pulse valves 13*a*, 13*b* are used to control the gases introduced into the vacuum chamber 20. Since an apparatus using such pulse valves uses small amounts of gases at one time and can be portable with integrated small gas storage containers, there is a strong demand for making the apparatus compact. The present invention is thus more suitably applicable to such uses.

(8) In the mass spectrometry device 1 in the present embodiment, the valve assembly 10 includes a mounting plate 151 that is attached to the partition wall 22 of the mass spectrometry device 1, and a penetrating member 152 that is provided on a back surface side of the mounting plate so as to project therefrom and penetrates through the partition wall 22, wherein the mounting plate 151 is attached to the partition wall 22 with the O-ring 21 therebetween, thereby sealing the vacuum chamber 20 in the mass spectrometry device 1. In this way, since the valve assembly 10 can be separated from the vacuum chamber 20, replacement of the pulse valves 13*a*, 13*b* becomes easy and a leak in the valve assembly 10 can be distinguished from that in the vacuum chamber 20.

(9) The mass spectrometry device 1 in the present embodiment includes a mass spectrometer having an ion trap 30 to which ions and gases are supplied, wherein the plurality of gases, whose flow rates are regulated in the plurality of gas valves 13*a*, 13*b*, include at least a gas species for a cooling gas and a gas species for a CID gas. Since an ion trap mass spectrometer is arranged on a desk or is portable for use, there is a strong demand for making the mass spectrometer compact. The present invention is thus suitably applied to such uses.

The present invention can also be applied to an analytical device including no mass spectrometer as long as it has a gas storage container attached thereto; thus, the analytical device is not particularly limited to a particular type. Furthermore, the valve assembly 10 may be attached to a chamber other than a vacuum chamber.

According to the embodiment of the present invention described above, it is possible to reduce the area required for attaching the connecting parts for the gas conduits on the vacuum chamber of the analytical device, and also possible to facilitate the assembly work.

The present invention is not limited to the above embodiment. Other embodiments contemplated in the technical idea of the present invention are also included within the scope of the present invention.

What is claimed is:

1. An analytical device comprising:

a valve assembly that is connected to a plurality of gas supply conduits; and a gas supply chamber to which a plurality of gases are supplied through the valve assembly, wherein:

the valve assembly comprises a plurality of valves that regulate flow rates of the plurality of gases supplied to the gas supply chamber through the plurality of gas supply conduits, a fixing member that integrally fixes the plurality of valves, a plurality of first sealing members that seal the plurality of valves against the fixing member; and a retainer that is fastened to the fixing member to integrally press the first sealing member against the fixing member.

2. The analytical device according to claim 1, further comprising:

a plurality of pressing members that are forced by the retainer to press the plurality of first sealing members against the fixing member.

3. The analytical device according to claim 1, wherein:

the retainer comprises a supporting part that supports one or more of a plurality of joints connected to the plurality of gas supply conduits that guide gases to the plurality of valves.

4. The analytical device according to claim 2, wherein:

the retainer comprises a supporting part that supports one or more of a plurality of joints connected to the plurality of gas supply conduits that guide gases to the plurality of valves.

5. The analytical device according to claim 3, further comprising:

a connecting conduit that is connected to the joint on one end and to the valve on another end, the joint being connected to the connecting conduit on one end and to the gas supply conduits on another end.

6. The analytical device according to claim 4, further comprising:

a connecting conduit that is connected to the joint on one end and to the valve on another end, the joint being connected to the connecting conduit on one end and to the gas supply conduits on another end.

7. The analytical device according to claim 3, wherein:

the retainer comprises a first plate-like member that is fastened to the fixing member and a second plate-like member comprising the supporting part.

8. The analytical device according to claim 4, wherein:

the retainer comprises a first plate-like member that is fastened to the fixing member and a second plate-like member comprising the supporting part.

9. The analytical device according to claim 5, wherein:

the retainer comprises a first plate-like member that is fastened to the fixing member and a second plate-like member comprising the supporting part.

10. The analytical device according to claim 6, wherein:

the retainer comprises a first plate-like member that is fastened to the fixing member and a second plate-like member comprising the supporting part.

11. The analytical device according to claim 7, wherein:

the first plate-like member and the second plate-like member are arranged such that a plane formed by the first plate-like member and a plane formed by the second plate-like member intersect each other.

12. The analytical device according to claim 8, wherein:

the first plate-like member and the second plate-like member are arranged such that a plane formed by the first plate-like member and a plane formed by the second plate-like member intersect each other.

13. The analytical device according to claim 9, wherein:

the first plate-like member and the second plate-like member are arranged such that a plane formed by the first plate-like member and a plane formed by the second plate-like member intersect each other.

14. The analytical device according to claim 10, wherein:

the first plate-like member and the second plate-like member are arranged such that a plane formed by the first plate-like member and a plane formed by the second plate-like member intersect each other.

15. The analytical device according to claim 1, wherein:

the valve is a pulse valve.

16. The analytical device according to claim 1, wherein:

the valve assembly comprises a mounting member that is attached to a partition wall of the analytical device and a penetrating member that is provided on a back surface side of the mounting member so as to protrude therefrom and penetrates through the partition wall, wherein the mounting member is attached to the partition wall with a second sealing member therebetween, thereby sealing the vacuum chamber in the analytical device.

17. The analytical device according to claim 1, comprising:

a mass spectrometer in which ions and the gases are supplied to the gas supply chamber, wherein:

the gas supply chamber comprises an electrode that controls the ions, and the plurality of gases, whose flow rates are regulated by the plurality of valves, comprise at least a gas species for a cooling gas and a gas species for a CID gas.

* * * * *